US008006514B2

(12) United States Patent
Tsuboi

(10) Patent No.: US 8,006,514 B2
(45) Date of Patent: Aug. 30, 2011

(54) REFRIGERATING DEVICE

(75) Inventor: Noboru Tsuboi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 149 days.

(21) Appl. No.: 12/475,880

(22) Filed: Jun. 1, 2009

(65) Prior Publication Data

US 2010/0031695 A1 Feb. 11, 2010

(30) Foreign Application Priority Data

Aug. 8, 2008 (JP) ..... 2008-205250

(51) Int. Cl.
*F25B 43/02* (2006.01)

(52) U.S. Cl. ..... 62/468; 62/470

(58) Field of Classification Search ..... 62/192, 62/193, 468, 470, 498; 418/98, 99, 104, 418/199; 417/372, 369
See application file for complete search history.

(56) References Cited

U.S. PATENT DOCUMENTS

| | | | | |
|---|---|---|---|---|
| 3,859,815 | A * | 1/1975 | Kasahara | 62/197 |
| RE32,055 | E * | 12/1985 | Schibbye et al. | 418/1 |
| 4,676,075 | A * | 6/1987 | Shiibayashi | 62/469 |
| 5,222,874 | A * | 6/1993 | Unnewehr et al. | 417/372 |
| 5,653,585 | A * | 8/1997 | Fresco | 418/100 |
| 6,216,474 | B1 * | 4/2001 | Sishtla | 62/84 |
| 6,532,755 | B2 * | 3/2003 | Ichikawa et al. | 62/228.3 |
| 2008/0152524 | A1 * | 6/2008 | Kishi et al. | 418/1 |

FOREIGN PATENT DOCUMENTS

| | | |
|---|---|---|
| CN | 1165249 A | 11/1997 |
| CN | 1690590 A | 11/2005 |
| JP | 60-255038 | 12/1985 |
| JP | 10-112949 | 4/1998 |
| JP | 2006-118417 | 5/2006 |

OTHER PUBLICATIONS

Office Action issued Nov. 5, 2010, in China Patent Application No. 200910165253.3 (with English-language Translation).

* cited by examiner

*Primary Examiner* — Mohammad Ali
(74) *Attorney, Agent, or Firm* — Oblon, Spivak, McClelland, Maier & Neustadt, L.L.P.

(57) ABSTRACT

In a refrigerating device comprising: a compressor that is driven by a motor; a refrigerant circulation flow passage that includes an oil separator/collector, a condenser, an expansion valve, and an evaporator; and an oil flow passage that conducts oil in the oil separator/collector to a bearing of the compressor, an oil supply opening is provided for a motor casing that stores the motor, an oil supply line for supplying oil from an oil sump of the refrigerant circulation flow passage on the discharge side of the compressor to the oil supply opening is provided, oil is supplied to the oil supply opening through the oil supply line, and oil is distributed across surfaces of windings of the motor. And an internal pressure of the motor casing is lower than a pressure in the oil sump in the refrigerant circulation flow passage on the discharge side of the compressor, consequently oil is easily distributed across the entire motor casing. In such a refrigerating device, an insulation capability of the motor does not decrease with the elapse of long time.

9 Claims, 7 Drawing Sheets

REFRIGERATING DEVICE

BACKGROUND OF THE INVENTION

1. Field of the Invention

The present invention relates to a refrigerating device, and more particularly to a refrigerating device for an ammonia refrigerant employing ammonia as a refrigerant.

2. Description of the Related Art

Conventionally, there have been known refrigerating devices which use ammonia gas as a refrigerant, and compressors which compress the ammonia gas. In an ammonia-refrigerant electric compressing device according to Japanese Laid-Open Patent Publication (Kokai) No. H10-112949, in order to insulate respective parts of a motor (such as windings of a stator of the motor), a fluoro resin and the like are used. In the ammonia refrigerant electric compressing device, if the ammonia gas and a lubricant which is insoluble to the ammonia gas are simultaneously used, they are not smoothly circulated in the device. Therefore, as the lubricant, ether oil which is compatible with ammonia is employed. In the device, the lubricant stored at a bottom of the device is pumped up through a rotor shaft of the motor arranged in the vertical direction, and is sprayed by means of gravity from a center hole of the rotor shaft provided at the uppermost portion of the motor to the windings of the stator arranged below. Though the invention is intended to bring the windings of the stator in a state submerged by the lubricant, thereby shutting off a direct contact to ammonia, there is a limitation to deliver the lubricant over the entire windings. Moreover, the structure for storing the lubricant becomes complex, resulting in a large increase in cost. Further, the structure essentially requires an arrangement for vertically standing the motor, resulting in a demerit of restriction on the environment for installation.

In a screw compressor for ammonia according to Japanese Laid-Open Patent Publication (Kokai) No. 2006-118417, though a motor stator and a coil end portion of a motor of the screw compressor are entirely submerged in a oil, a motor rotor rotates at a high speed in the oil with a high viscosity, resulting in a large agitating loss. Consequently, there poses a problem that a required power increases.

Among resins, fluoro resin is especially inactive to most of chemicals, and is considered to have an excellent chemical resistance. However, according to research carried out by the present inventor, even if the fluoro resin providing such excellent chemical resistance is used along with the ammonia gas, and the appearance of the fluoro resin is not damaged, an insulation capability of the motor decreases with the elapse of time.

SUMMARY OF THE INVENTION

The present invention is devised based on this new knowledge, and has an object to provide a refrigerating device which does not present a decrease in the insulation capability of a motor after a long period has elapsed.

In order to solve the above problem, a refrigerating device according to the present invention includes a compressor that is driven by a motor; a refrigerant circulation flow passage that comprises an oil separator/collector, a condenser, an expansion valve, and an evaporator; an oil flow passage that conducts oil in the oil separator/collector to a bearing and a shaft seal unit of the compressor; a motor casing that stores the motor, an internal pressure of the motor casing is lower than a pressure in an oil sump in the refrigerant circulation flow passage on a discharge side of the compressor; an oil supply opening that is provided for the motor casing; and an oil supply line that is constructed to supply oil from the oil sump to the oil supply opening.

With this configuration, by supplying the oil from the oil sump in the refrigerant circulation flow passage on the discharge side of the compressor through the oil supply line to the oil supply opening of the motor, the oil can be distributed across surfaces of windings, and the oil with a high insulation property can be interposed between the windings. As a result, even after a long period has elapsed, it is possible to maintain the insulation capability of the motor without a decrease. Thus, even if a fluoro resin having permeability for ammonia gas is used for the windings of the motor, by interposing the oil between the windings, it is possible to maintain, without a decrease, the insulation capability of the motor after a long period has elapsed. As a result, it is possible to increase a reliability of a semi-hermetic ammonia refrigerating device.

The refrigerating device according to the present invention preferably includes a control valve that is provided for the oil supply line, and control means that controls the control valve so as to adjust a quantity of oil supplied to the oil supply opening. With this configuration, it is possible to control intermittent opening of the control valve, and to supply the oil on desired time and at an interval, for example. In other words, it is possible to supply the motor with the oil continuously as well as intermittently in response to necessity, and to adjust the quantity of the oil supplied in a unit period, thereby avoiding the oil from being excessively supplied. As a result, a decrease in performance can be prevented.

The refrigerating device according to the present invention is preferably configured such that the oil before cooled by an oil cooler provided for the oil flow passage is supplied to the oil supply opening of the motor from the oil flow passage via the oil supply line. With this configuration, it is possible to supply the oil which is not cooled by the oil cooler to the oil supply opening of the motor, from the oil flow passage via the oil supply line. As a result, it is possible to maintain the temperature of the coils of the motor without a decrease. By directly supplying the oil which is not cooled from the separator/collector to the oil supply opening of the motor, it is possible to main the coil temperature of the motor without a decrease, thereby preventing the ammonia gas from being liquefied on the coils.

The refrigerating device according to the present invention is preferably configured such that the oil sump is an oil sump portion of the oil separator/collector, or in multi-stage screw rotors, the oil sump is an oil sump in an intermediate-stage portion between one pair of screw rotors and the other pair of screw rotors adjacent to the one pair of screw rotors out of the multi-stage screw rotors. With this configuration, it is possible to supply the oil from the oil sump portion of the oil separator/collector, or the oil sump in an intermediate-stage portion of the multi-stage screw rotors. Consequently, it is not necessary to supply the oil from the outside. Moreover, when the oil is supplied from the oil sump of the intermediate-stage portion of the compressor, it is possible to obtain the oil with a small quantity of dissolved ammonia gas, and, when the oil is sprayed on a motor portion, it is possible to restrain the generation quantity of a flash gas, thereby preventing a decrease in the performance.

The refrigerating device according to the present invention is preferably configured such that a suction opening of the compressor is provided on an opposite side of the motor casing with respect to the discharge side of the compressor. This configuration more surely allows the supplied oil to be distributed inside the motor and pass across the motor, by means of the ammonia refrigerant gas sucked from the suction opening of the compressor.

The refrigerating device according to the present invention is preferably configured such that an aluminum wire of the winding of the motor is loosely covered by a fluoro resin. In this context, the loose coverage means that the aluminum wire is covered by the fluoro resin without a close contact. With this configuration, even if the thermal expansion coefficient of the fluoro resin covering the aluminum wire of the winding is larger than the thermal expansion coefficient of the aluminum wire of the winding, since the aluminum wire is loosely covered by the fluoro resin, the fluoro resin can expand without constraint of the aluminum wire. As a result, it is possible to prevent the fluoro resin from being broken.

DETAILED DESCRIPTION OF THE PREFERRED EMBODIMENTS

A description will now be given to embodiments of the present invention with reference to drawings.

Figure 1:
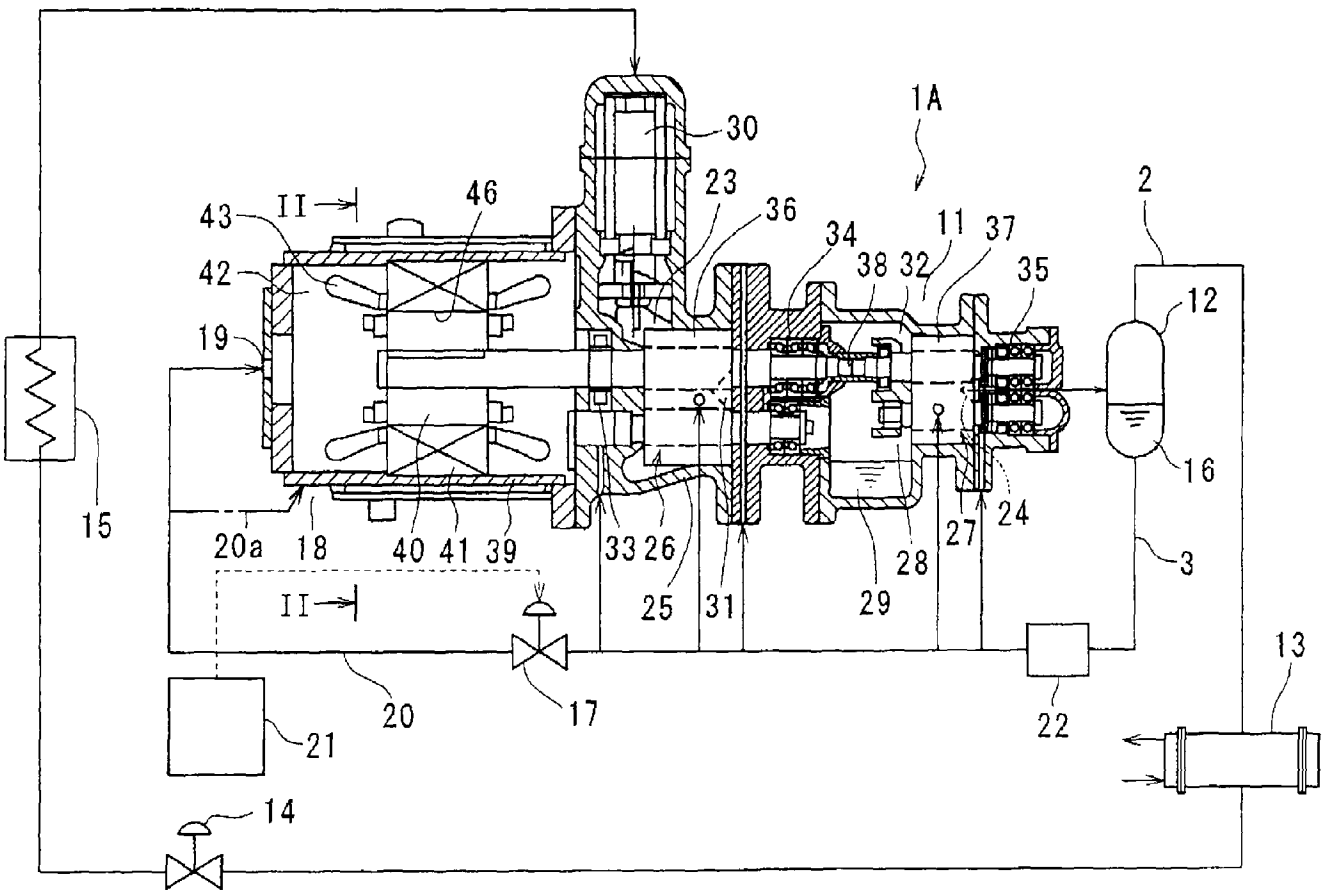
FIG. 1 shows a two-stage screw refrigerating device for ammonia refrigerant according to a first embodiment of the present invention.

FIG. 1 shows a two-stage screw refrigerating device for ammonia refrigerant 1A according to a first embodiment of the present invention. The two-stage screw refrigerating device 1A includes a refrigerant circulation flow passage 2 which contains a two-stage oil-cooled screw compressor 11 (hereinafter, simply referred to as screw compressor 11), an oil separator/collector 12, a condenser 13, an expansion valve 14, and an evaporator 15, an oil flow passage 3 which conducts an oil in the oil separator/collector 12, namely the oil in an oil sump portion 16 at a bottom portion of the oil separator/collector 12 to after-mentioned oil supply locations in the screw compressor 11, and an oil supply line 20 which branches from the oil flow passage 3, and supply oil via a control valve 17 to an oil supply opening 19 of an after-mentioned motor 18. A control device (control means) 21 which controls the control valve 17 is provided. Between the oil separator/collector 12 and the oil supply locations of the oil flow passage 3, a cooler 22 which cools the oil is provided.

The screw compressor 11 includes a pair of first-stage male/female screw rotors 26 meshing with each other, and a pair of second-stage male/female screw rotors 27 meshing with each other in a compressor casing 25. And a suction opening 23 is formed on one side of the compressor casing 25, and a discharge opening 24 is formed on the other side thereof. In an intermediate-stage portion 28 between the first-stage screw rotors 26 and the second-stage screw rotors 27, an intermediate oil sump 29 for storing the oil is formed. On an upstream side of the suction opening 23, a filter 30 is provided. On a side of the intermediate-stage portion 28 of the first-stage screw rotors 26, a discharge portion 31 is provided. On a side of the intermediate-stage portion 28 of the second-stage screw rotors 27, a suction portion 32 is provided. Moreover, the first-stage screw rotors 26 and the second-stage screw rotors 27 are rotationally supported by bearing/shaft seal units 33, 34, and 35, and a male rotor 36 of the first-stage screw rotors 26 and a male rotor 37 of the second-stage screw rotors 27 share a rotor shaft 38 for coaxially rotating. Further, a motor casing 39 of the motor 18, which is a driving unit of the screw compressor 11 forms, along with a compressor casing 25 which is integrally joined to the motor casing 39, a semi-hermetic structure. In the motor casing 39, a motor chamber 42 is provided, and the motor chamber 42 stores a rotor 40 which shares the shaft with the male rotor 36 of the first-stage screw rotors 26, and a stator 41 enclosing the rotor 40. Thus, the shaft of this male rotor 36 also constitutes an output shaft of the motor 18. And the motor 18 drives the first-stage screw rotors 26 and the second-stage screw rotors 27 to rotate via this male rotor 36 and the male rotor 37 of the second-stage screw rotors 27.

Figure 2:
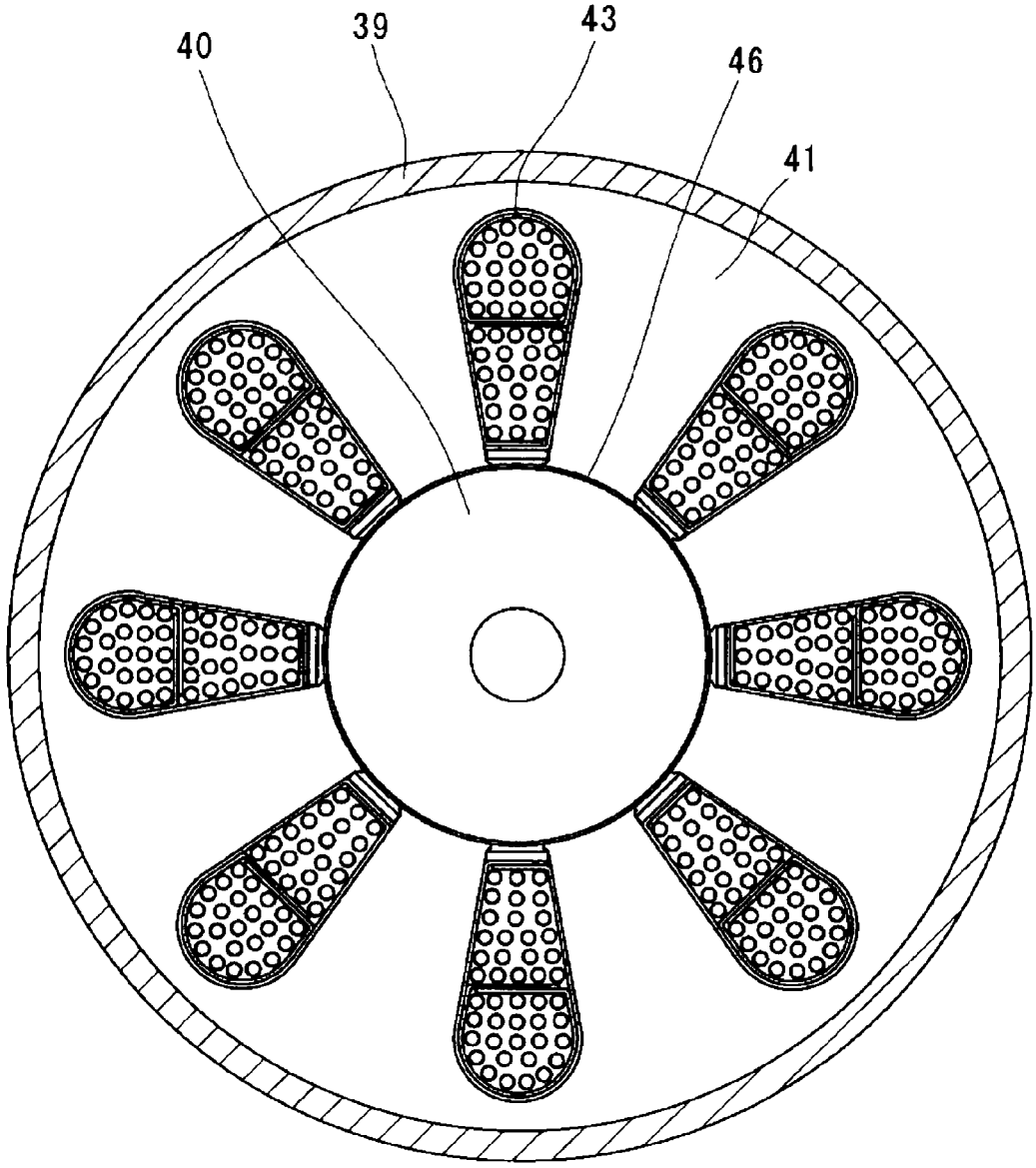
FIG. 2 is a cross sectional view of a motor taken from line II-II in FIG. 1.
Figure 3:
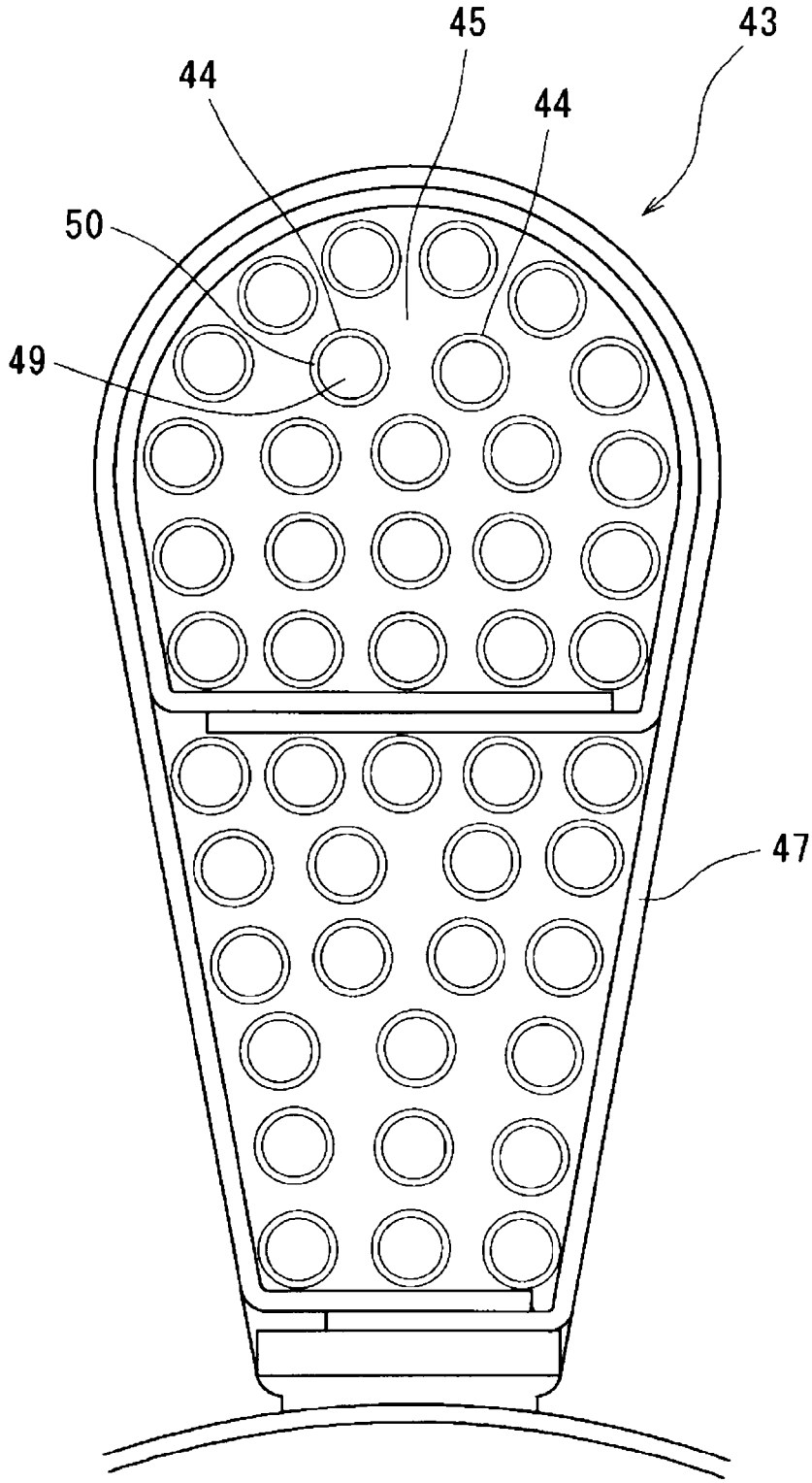
FIG. 3 is an enlarged cross sectional view of an essential part of windings of a stator of the motor.

A large number of windings 43 are wound inside insulation casings 47 of the stator 41 of the motor 18 shown in FIGS. 2 and 3. There are spaces 45 between the windings 44 and 44. Aluminum wires 49 of the windings 44 of the stator 41 of the motor 18 are loosely covered by a fluoro resin 50. The fluoro resin herein includes polytetrafluoroethylene (PTFE), tetrafluoroethylene/perfluoro alkyl vinyl ether copolymer (PFA), tetrafluoroethylene/hexafluoropropylene copolymer (FEP), tetrafluoroethylene/ethylene copolymer (ETFE), polyvinylidene fluoride (PVDF), and polychlorotrifluoroethylene (PCTFE). According to the present embodiment, FEP is used. The oil supply opening 19 is provided for an opposite side surface of the motor casing 39 of the motor 18 with respect to the first-stage screw rotors 26. The center of the oil supply opening 19 is coaxial with the rotation shaft of the motor 18. Via the oil supply opening 19, the oil supply line 20 and the motor chamber 42 communicate with each other. The oil supply opening 19 is not limited to the one provided at the above-described location, and a part of the oil supply line 20 may be configured as an oil supply line 20*a* shown in a dashed-dotted line, and the oil supply opening 19 may be provided at a end portion of the oil supply line 20*a*, namely on an outer peripheral surface of the opposite side of the motor casing 39 of the motor 18 with respect to the first-stage screw rotors 26.

Then, a description will now be given to an operation of the two-stage screw refrigerating device for ammonia refrigerant 1A according to the first embodiment of the present invention.

The ammonia refrigerant gas sucked from the suction opening 23 of the screw compressor 11 is compressed while the oil from the oil flow passage 3 is being fed, and is discharged along with the oil from the discharge portion 31 to the intermediate-stage portion 28. Further, the ammonia refrigerant gas accompanying the oil is sucked from the suction portion 32 into the second-stage screw rotors 27, is compressed while the oil from the oil flow passage 3 is being fed, and is discharged accompanying the oil from the discharge opening 24 to the oil separator/collector 12. The oil supplied to the bearing/shaft seal units 33, 34, and 35 is also returned to the oil separator/collector 12, the oil separator/collector 12 separates the ammonia refrigerant gas and the oil from each other, the oil is temporarily stored in the oil sump portion 16, and the ammonia refrigerant gas from which the oil has been separated is fed out to a portion of the refrigerant circulation flow passage 2 extending from a top portion of the oil separator/collector 12.

Heat is taken from the ammonia refrigerant gas exiting from the oil separator/collector 12 by a low-temperature heat source such as water in the condenser 13, the ammonia refrigerant gas is condensed into a refrigerant liquid, the refrigerant liquid flows from the condenser 13 to the expansion valve 14, is partially vaporized into gas through the expansion valve 14 to lower the temperature, the refrigerant gas takes heat from a high-temperature heat source in the evaporator 15, is completely vaporized into gas, passes through the filter 30, and returns to the suction opening 23 of the two-stage screw refrigerating device 1A.

On the other hand, since the oil in the oil sump portion 16 is at high temperature by the compression of the screw compressor 11, the oil is cooled by the cooler 22 of the oil flow passage 3, is fed to the bearing/shaft seal units 33, 34, and 35, is conducted to each of the gas compression spaces formed by the first-stage screw rotors 26 and the second-stage screw rotors 27, and is collected by the oil separator/collector 12 for repeated use for circulating. On this occasion, since the gas compression spaces are spaces in the gas compression process, the gas compression spaces do not communicate with the suction opening 23, the discharge opening 21, the suction portion 32, and the discharge portion 24.

Moreover, the oil in the oil supply line 20 branching from the oil flow passage 3 is supplied via the control valve 17 to the oil supply opening 19 of the motor 18. The supplied oil is scattered in the motor chamber 42, and tends to be conducted to the spaces 45 between the windings 44 of the stator 41 of the motor 18. The oil after passing through the motor chamber 42, passes through the bearing/shaft seal unit 33, and is finally fed to the oil separator/collector 12. It should be noted that the oil used by the present embodiment is AG46 from Nippon Oil Corporation.

In general, on the surface of the fluoro resin, a large number of minute holes exist. As a result, after a long period elapses, because the ammonia gas along with moisture taken into the ammonia gas, passes the minute holes in the fluoro resin on the surface of the windings 44 of the motor 18, a water solution containing ammonia ion and hydroxide ion is generate, and the generated water solution causes conduction between windings 44 and 44 neighboring each other, resulting in a decrease in insulation capability of the motor 18. According to the present invention, since the oil is supplied from the oil supply line 20 at a high pressure to the oil supply opening 19 of the motor 18, the oil is sprayed and is distributed across the entire surface of the windings 44, and closes the minute holes of the fluoro resin, the oil of the refrigerating device with a high insulation property interposes between the windings 44. As a result, after a long period elapses, the insulation capability of the motor 18 will not decrease. Moreover, according to the first embodiment of the present invention, the oil sumps in the refrigerant circulation flow passage 2 on the discharge side of the screw compressor 11 are the oil sump portion 16 of the oil separator/collector 12 and the oil sump 29 of the intermediate-stage portion 28 between the first-stage screw rotors 26 and the second-stage screw rotors 27, and the former oil sump is employed as a source of the oil supply to the oil supply opening 19 of the motor. Then, since the oil sump portion 16 of the oil separator/collector 12 is employed as the source of the oil supply, it is not necessary to supply the oil from the outside.

Figure 4:
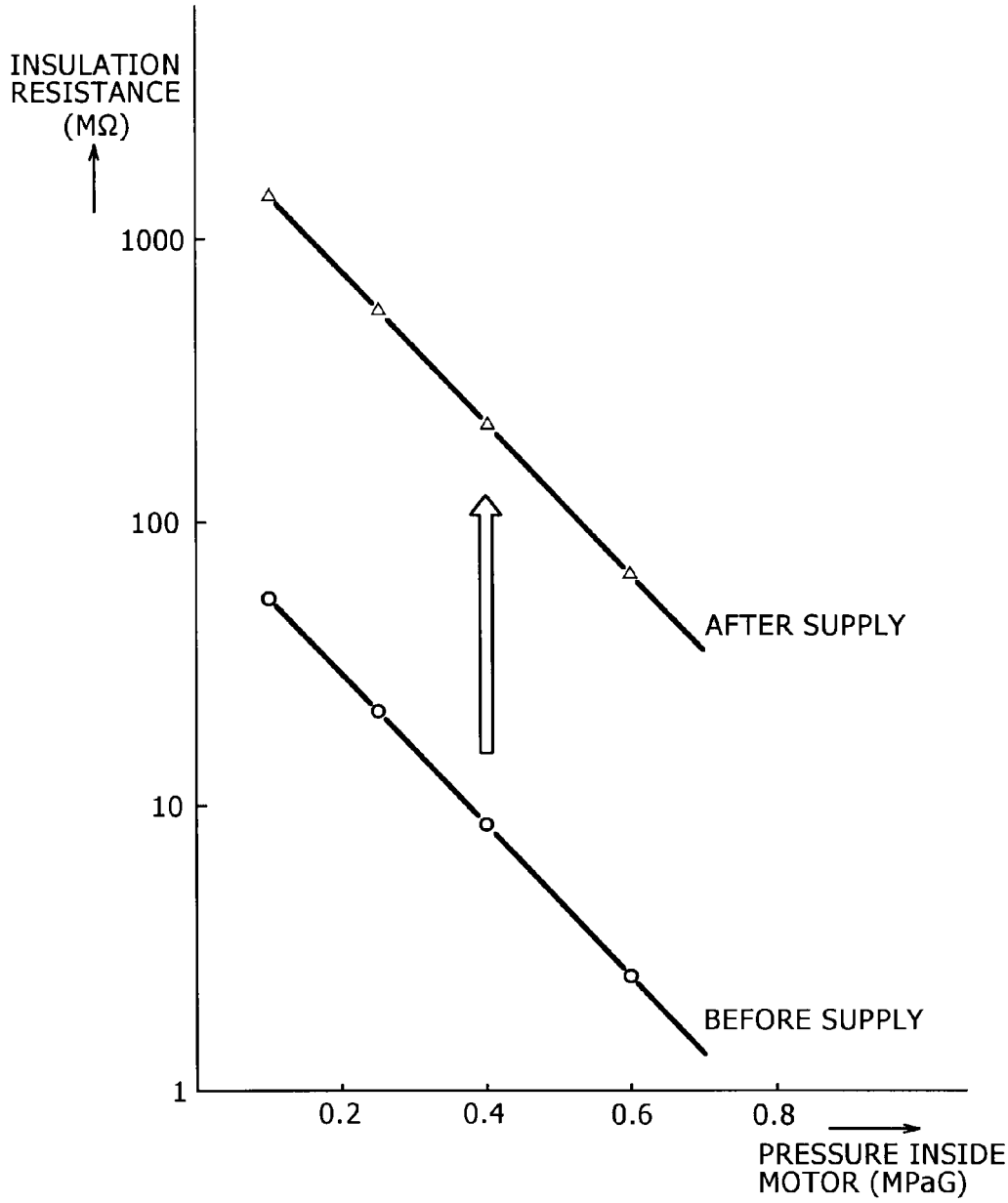
FIG. 4 is a chart showing a difference in an insulation resistance of the motor after a long period of use between before and after oil is supplied between the windings of the motor.

FIG. 4 shows a result of a measurement of an insulation resistance of the motor 18 after a predetermined long period, carried out by the present inventor in order to clarify a difference between before and after the oil is supplied between the windings 44 and 44 of the motor 18. It is appreciated that the insulation resistance of the motor 18 largely increases after the supply of the oil in comparison to before the supply of the oil. Based on this result, it is considered that the oil needs to be interposed between the windings 44 and 44 of the motor 18.

The oil supply from the oil flow passage 3 via the oil supply line 20 to the oil supply opening 19 is carried out by the control of the control device 21 for opening/closing the control valve 17. On both an oil supply start time and on an oil supply stop time set in advance by a not-shown input unit of the control device 21, the control device 21 controls the control valve 17 to correctly open and close, and adjusts an opening of the control valve 17 or adjusts an open period and a closed period of the control valve 17 per unit time period to control the quantity of the oil supply.

The pressure on the primary side of the control valve 17 is maintained to a pressure approximately the same as a discharge pressure of the screw compressor 11, and is higher than that in the motor chamber 42 inside the motor casing 39, which is approximately the same as a suction pressure, and, thus, when the control valve 17 is opened, the oil is supplied via the oil supply opening 19 into the motor chamber 42.

An example of the difference in pressure is as follows. The discharge pressure Pd at the discharge opening 24 is 1.6 MPa, the suction pressure Ps at the suction opening 23 is 0.05 MPa, and thus, the difference in pressure $\Delta P$ is 1.55 MPa. It should be noted that the pressure inside the motor chamber 42 is approximately equal to the suction pressure at the suction opening 23.

Since the supply of the oil into the windings 43 of the motor chamber 42 is positively carried out by means of the difference in pressure, it is possible to more easily distribute the oil across the entire space under the relatively low pressure in comparison to spray by means of gravity.

The control through the control valve 17 for supply of the oil to the motor chamber 42 allows intermittent supply of the oil in the required quantity while the timing is freely selected. As a result, the supply of the oil to the motor chamber 42 to the minimum necessary allows the restraint of increase of a friction resistance caused by an excessive supply of the oil and the prevention of the decrease of performance of the motor 18. Moreover, the more oil is supplied from the supply opening 19 of the motor 18, the more space is occupied by the oil in the gas compression rooms which is not shown, thereby reducing the quantity of the gas sucked from the suction opening 23, and, therefore, reducing the quantity of refrigerant passing through the evaporator 15, resulting in a decrease in performance. Also for this reason, it is desirable to supply the oil intermittently rather than continuously, thereby adjusting the supplied quantity of the oil so as not to be excessive.

Figure 5:
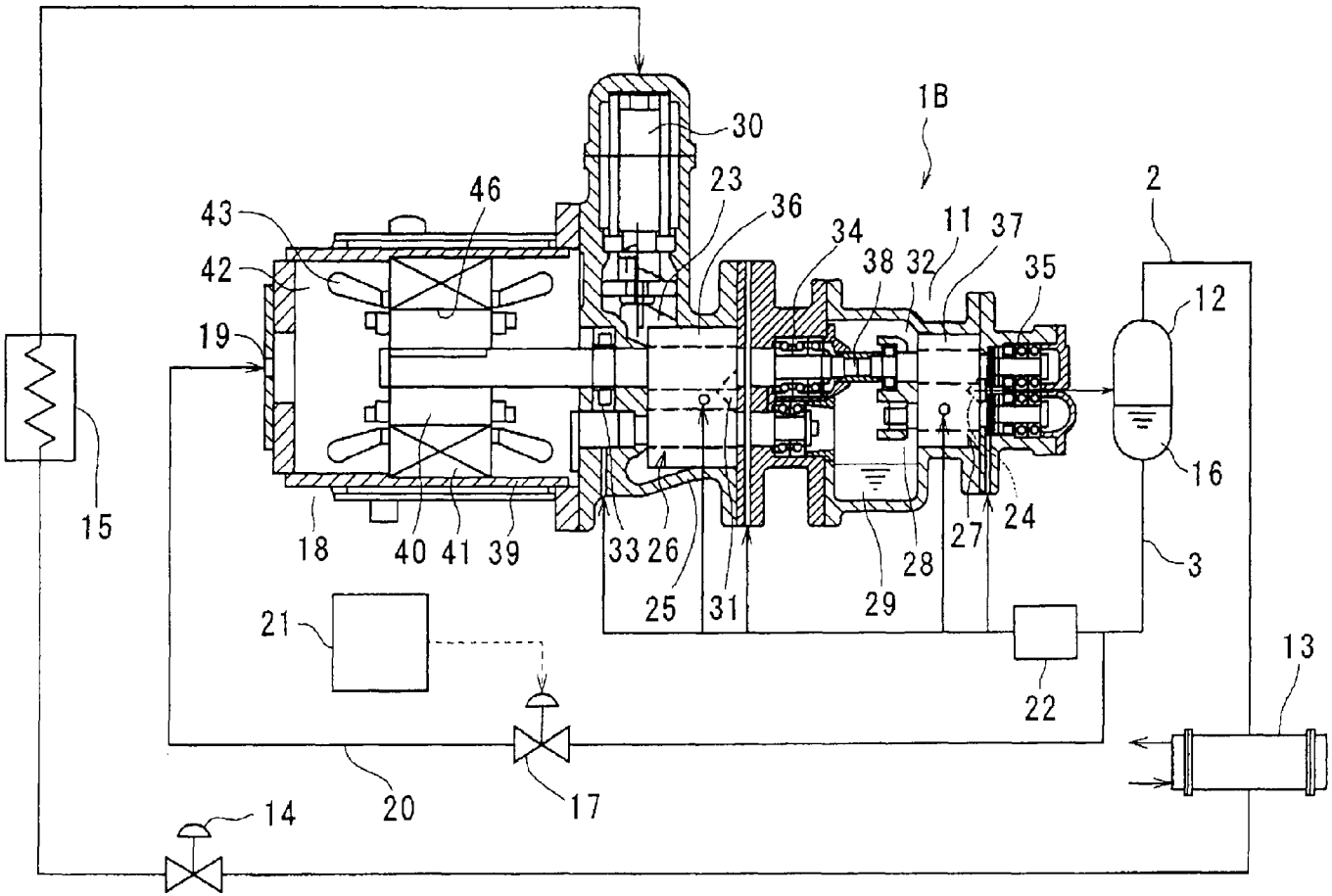
FIG. 5 shows a two-stage screw refrigerating device for ammonia refrigerant according to a second embodiment of the present invention.

FIG. 5 shows a two-stage screw refrigerating device for ammonia refrigerant 1B according to a second embodiment of the present invention. Same components of the present embodiment are denoted by same numerals as of the first embodiment and will not be further explained. According to the present embodiment, the branch location from the oil flow passage 3 to the oil supply line 20 is between the oil separator/collector 12 and the cooler 22, which is different from the first embodiment. With this configuration, the oil supplied by the oil supply line 20 is not cooled by the cooler 22. Thus, the supply of the oil does not cause the decrease of the temperature of the coils (windings 44) of the motor 18, thereby preventing the ammonia gas from being liquefied on the coils.

Figure 6:
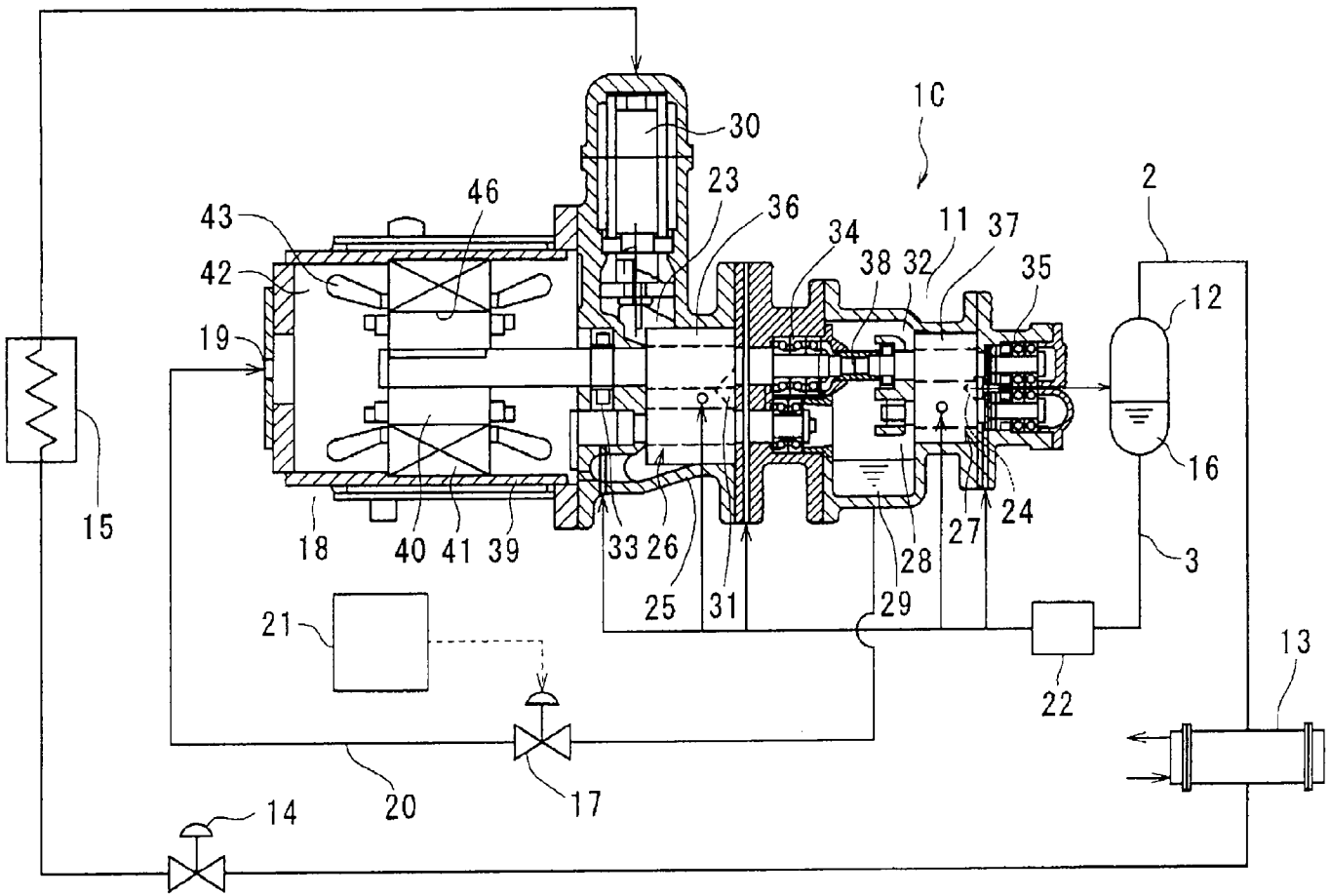
FIG. 6 shows a two-stage screw refrigerating device for ammonia refrigerant according to a third embodiment of the present invention.

FIG. 6 shows a two-stage screw refrigerating device for ammonia refrigerant IC according to a third embodiment of the present invention. Same components in the present embodiment are also denoted by same numerals as of the first embodiment and will not be further explained. According to the present embodiment, a point different from the first embodiment is that the source of the oil supply is not the oil separator/collector 12, but the intermediate oil sump 29 in the intermediate-stage portion 28, and the oil supply line 20 does not communicate with the oil flow passage 3.

The pressures at the respective locations according to the present embodiment are as follows. For example the suction pressure Ps at the suction opening 23 is 0.05 MPa, the discharge pressure Pd at the discharge opening 24 is 1.6 MPa, and the intermediate pressure Pm at the intermediate-stage portion 28 is 0.4 MPa.

According to the Henry's law, at a certain temperature, the quantity of a gas dissolved in a liquid in a certain quantity is proportional to the pressure (partial pressure) of the gas. Moreover, the temperatures of the ammonia refrigerant gas gradually increases, as the ammonia refrigerant gas flows from the suction opening 23 through the intermediate-stage portion 28 to the discharge opening 24. Therefore, it is considered that the quantity of the ammonia refrigerant gas dissolved in the oil at the respective locations is approximately proportional to the pressure at the respective locations (since the temperature of the respective locations are not constant, it is not considered that the dissolved quantity is completely "proportional" to the pressure). In other words, the quantity of the ammonia refrigerant gas dissolved in the oil at the respective locations increases as the ammonia refrigerant gas flows from the suction opening 23, via the intermediate-stage portion 28, to the discharge opening 24. Thus, the solubility of the ammonia refrigerant gas to the oil is smaller in the oil sump 29 in the intermediate-stage portion 28 than in the oil sump portion 16 of the oil separator/collector 12, which is under pressure approximately equal to that at the discharge opening 24.

The ammonia gas dissolved in the oil under the high pressure, upon being sprayed from the oil supply opening 19, becomes the ammonia gas again in the motor chamber 42 under the relatively low pressure, and occupies a space. On this occasion, the gas appearing again in the motor chamber 42 is referred to as flash gas.

According to the present embodiment, by supplying the oil in the oil supply line 20 from the intermediate oil sump 29 of the intermediate-stage portion 28, it is possible to reduce the quantity of the ammonia refrigerant gas dissolved in the oil and supplied to the motor chamber 42, and, as a result, it is possible to reduce the quantity of the flash gas when the oil is supplied to the motor chamber 42. In this way, in correspondence to the decrease in quantity of the ammonia refrigerant gas supplied to the motor chamber 42, the quantity of the refrigerant passing through the evaporator 15 increases in comparison to the first and second embodiments, resulting in an increase in performance as the refrigerating device. Moreover, since the supply source of the oil is the intermediate oil sump 29 in the intermediate-stage portion 28 between the first-stage screw rotors 26 and the second-stage screw rotors 27, it is not necessary to supply the oil from the outside.

Also according to the present embodiment, the point that the oil is positively supplied into the windings 43 of the motor chamber 42 by means of the difference in pressure is the same as the first and second embodiments.

In case of a screw compressor, when a motor is installed on a compressor, the uppermost portion of the screw compressor becomes high, resulting in demerit in installation. When the screw compressor 11 is arranged horizontally, though the demerit relating to the height of the uppermost portion is eliminated, there is a difficulty in allowing the supplied oil to flow across the motor chamber 42 while passing through between the windings 44 and 44 in the motor chamber. However, by employing the method for filling the oil between the windings 44 and 44 by means of the difference in pressure, even if the screw compressor 11 is horizontally installed, it is possible to sufficiently distribute the oil between the windings 44 and 44.

Though the thermal expansion coefficient ($\alpha 2=100\times10^{-6}$ (1/K)) of the fluoro resin 50 covering the aluminum wire 49 of the winding 44 is larger than the thermal expansion coefficient ($\alpha 1=23.6\times10^{6}$ (1/K)) of the aluminum wire 49 of the winding 44, by loosely covering the aluminum wire 49 with fluoro resin 50, the fluoro resin 50 can expand without constraint imposed by the aluminum wire 49. As a result, it is possible to prevent the fluoro resin 50 from being broken.

Figure 7:
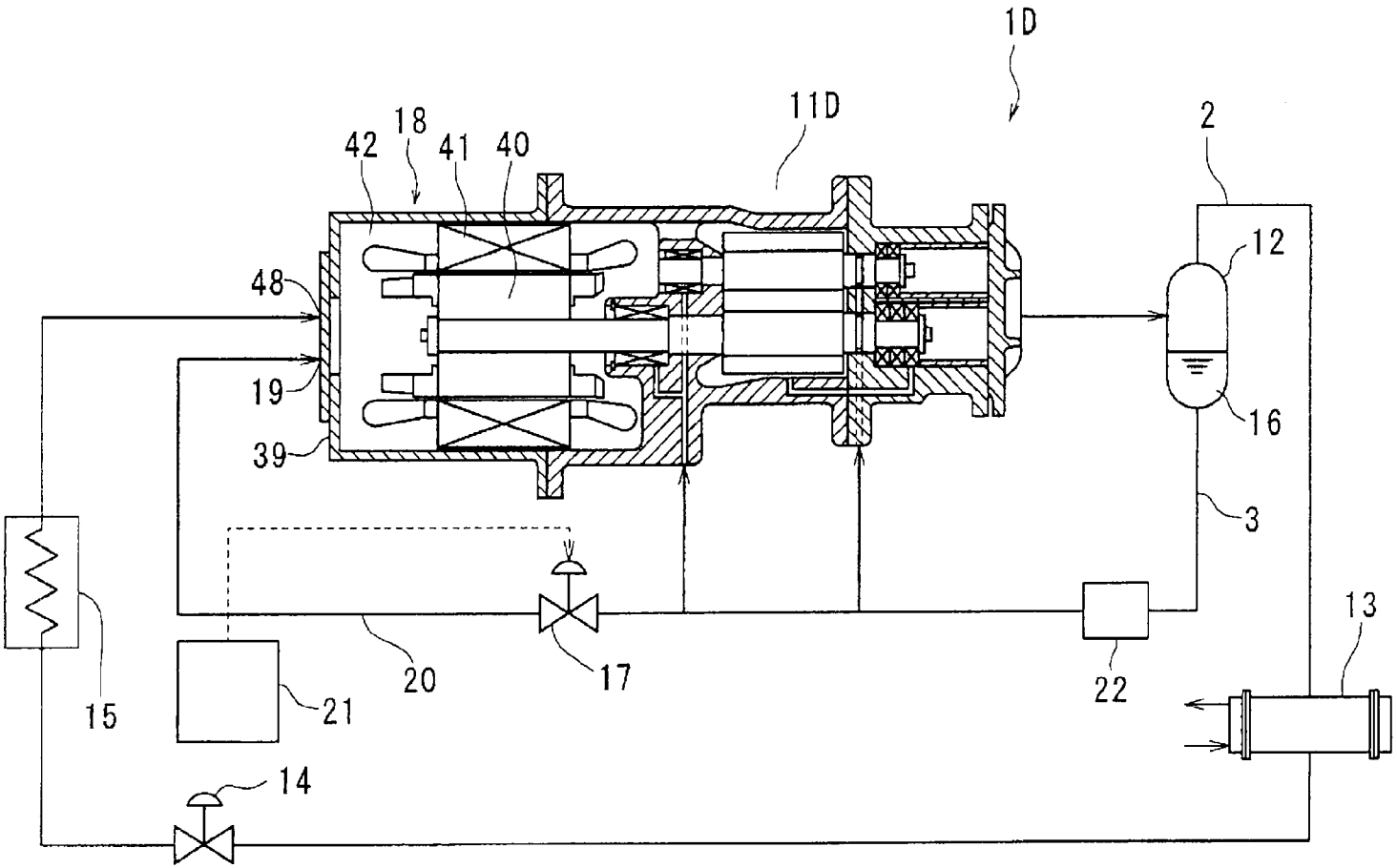
FIG. 7 shows a screw refrigerating device for ammonia refrigerant according to a fourth embodiment of the present invention.

According to the first and second embodiments of the present invention, though an example employing the two-stage screw compressor 11 is shown, the present invention is not limited to these, a single-stage screw compressor or a multi-stage screw compressor other than the two-stage screw compressor 11 may be used. Moreover, according to the third embodiment, a multi-stage screw compressor other than the two-stage screw compressor 11 shown in FIG. 6 may be used. Moreover, like a screw refrigerating device for ammonia refrigerant 1D according to a fourth embodiment shown in FIG. 7, the suction opening 48 of a compressor 11D may be provided on the opposite side of the motor casing 39 of the motor 18 with respect to the discharge side of the compressor 11D, thereby the ammonia refrigerant gas may pass through the motor chamber 42. This configuration more surely allows the supplied oil to be distributed inside the motor 18 and pass across the motor 18, by means of the ammonia refrigerant gas sucked from the suction opening 48 of the compressor 11D. According to the fourth embodiment, though a single stage screw compressor 11D is used as an example, the present invention is not limited to this, a multi-stage screw compressor may be used. According to the first to fourth embodiments of the present invention, though the screw compressors 11 and 11D are used as examples, the present invention is not limited to these, other compressors such as a scroll compressor may be used.

What is claimed is:

1. A refrigerating device comprising:

a motor having a wire winding covered by a fluoro resin electrical insulation;

a compressor driven by the motor;

a refrigerant circulation flow passage that comprises an oil separator/collector, a condenser, an expansion valve, and an evaporator;

an oil flow passage that conducts oil in said oil separator/collector to a bearing and a shaft seal unit of said compressor;

a motor casing that stores said motor, an internal pressure of said motor casing is lower than a pressure in an oil sump in said refrigerant circulation flow passage on a discharge side of said compressor;

an oil supply opening provided at said motor casing at a location axially beyond said wire winding, whereby oil from said oil supply opening can be scattered and distributed across the entire surface of the wire winding; and an oil supply line that is constructed to supply oil from said oil sump to said oil supply opening.

2. The refrigerating device according to claim 1, further comprising:

a control valve that is provided for said oil supply line; and control means that controls said control valve so as to adjust a quantity of oil supplied to said oil supply opening.

3. The refrigerating device according to claim 1, wherein an oil cooler is provided for said oil flow passage, and oil before cooling by said oil cooler is supplied to said oil supply opening from said oil flow passage via said oil supply line.

4. The refrigerating device according to claim 1, wherein said oil sump is an oil sump portion of said oil separator/collector.

5. The refrigerating device according to claim 1, wherein a suction opening of said compressor is provided on an opposite side of said motor casing with respect to the discharge side of said compressor.

6. The refrigerating device according to claim 1, wherein the wire winding of said motor is formed of aluminum wire.

7. The refrigerating device according to claim 1, wherein the oil supply opening is at an axial end of the motor casing and coaxial with a rotational axis of the rotor of said motor.

8. The refrigerating device according to claim 1, further comprising a refrigerant including ammonia provided in the refrigerant circulation flow passage.

9. A refrigerating device comprising:

a compressor that is driven by a motor;

a refrigerant circulation flow passage that comprises an oil separator/collector, a condenser, an expansion valve, and an evaporator;

an oil flow passage that conducts oil in said oil separator/collector to a bearing and a shaft seal unit of said compressor;

a motor casing that stores said motor, an internal pressure of said motor casing is lower than a pressure in an oil sump in said refrigerant circulation flow passage on a discharge side of said compressor;

an oil supply opening that is provided for said motor casing; and an oil supply line that is constructed to supply oil from said oil sump to said oil supply opening, wherein said compressor comprises multi-stage screw rotors, and said oil sump is an oil sump in an intermediate-stage portion between one pair of screw rotors and the other pair of screw rotors adjacent to said one pair of screw rotors out of said multi-stage screw rotors.

* * * * *